US007418753B2

(12) United States Patent
Kuchel et al.

(10) Patent No.: US 7,418,753 B2
(45) Date of Patent: Sep. 2, 2008

(54) ONE-SIDED MATTRESS

(75) Inventors: Bernhard W. Kuchel, Stone Mountain, GA (US); Michael S. DeFranks, Decatur, GA (US)

(73) Assignee: Dreamwell, Ltd, Las Vegas, NV (US)

( * ) Notice: Subject to any disclaimer, the term of this patent is extended or adjusted under 35 U.S.C. 154(b) by 202 days.

(21) Appl. No.: 11/209,455

(22) Filed: Aug. 23, 2005

(65) Prior Publication Data

US 2005/0278862 A1 Dec. 22, 2005

Related U.S. Application Data

(63) Continuation of application No. 10/661,327, filed on Sep. 12, 2003, now Pat. No. 6,931,685.

(51) Int. Cl.

| | |
|---|---|
| ***A47C 27/07*** | (2006.01) |
| ***A47C 23/04*** | (2006.01) |
| ***F16F 1/08*** | (2006.01) |
| ***B68G 9/00*** | (2006.01) |

(52) U.S. Cl. ..... 5/716; 5/720; 5/251; 5/256; 267/166.1; 267/180

(58) Field of Classification Search ..... 5/716, 5/720, 248, 251, 256, 655.7, 655.8; 267/103, 267/166, 166.1, 180

See application file for complete search history.

(56) References Cited

U.S. PATENT DOCUMENTS

| | | | | | |
|---|---|---|---|---|---|
| 26,954 | A | * | 1/1860 | Peck, Jr. | 5/256 |
| 85,938 | A | * | 1/1869 | Kirkpatrick | 5/254 |
| 140,975 | A | * | 7/1873 | Van Wert et al. | 5/258 |
| 274,715 | A | * | 3/1883 | Buckley | 267/180 |
| 380,651 | A | * | 4/1888 | Fowler et al. | 267/166.1 |
| 485,652 | A | * | 11/1892 | Pfingst | 267/166 |
| 569,256 | A | * | 10/1896 | Van Cise | 5/264.1 |
| 1,250,892 | A | * | 12/1917 | Johnson | 5/720 |
| 1,751,261 | A | * | 3/1930 | Wilson | 267/166.1 |
| 2,148,961 | A | * | 2/1939 | Pleet | 267/91 |
| 2,480,158 | A | * | 8/1949 | Owen | 267/91 |
| 3,751,025 | A | * | 8/1973 | Beery et al. | 267/166.1 |
| 4,003,563 | A | | 1/1977 | Taylor | |
| 4,038,711 | A | | 8/1977 | Golembeck | |
| 4,055,337 | A | | 10/1977 | Laiche | |
| 4,077,619 | A | * | 3/1978 | Borlinghaus | 267/166.1 |

(Continued)

FOREIGN PATENT DOCUMENTS

| | | |
|---|---|---|
| FR | 573923 | 11/1923 |

(Continued)

OTHER PUBLICATIONS

PCT International Searching Authority, PCT International Search Report and Written Opinion, mailed Nov. 18, 2004, ISA/US, Alexandria, Virginia, United States.

*Primary Examiner*—Robert G Santos
(74) *Attorney, Agent, or Firm*—Ropes & Gray LLP

(57) ABSTRACT

A one-sided mattress construction includes a spring assembly with asymmetric spring coils. Only the bottom portion of each spring coil is attached, either to adjacent spring coils or to a bottom surface of the mattress. The top portion of each spring may have a narrowing taper that permits the top to move independent of other adjacent springs.

14 Claims, 1 Drawing Sheet

U.S. PATENT DOCUMENTS

| | | | | |
|---|---|---|---|---|
| 4,111,407 | A * | 9/1978 | Stager | 267/166.1 |
| 4,449,261 | A | 5/1984 | Magnusson | |
| 4,548,390 | A | 10/1985 | Sasaki | |
| 4,664,361 | A | 5/1987 | Sasaki | |
| 5,652,986 | A | 8/1997 | Wells | |
| 5,868,383 | A | 2/1999 | Codos | |
| 6,170,807 | B1 | 1/2001 | Eto | |
| 6,173,464 | B1 | 1/2001 | McCune | |
| 6,243,900 | B1 | 6/2001 | Gladney et al. | |
| 6,256,820 | B1 | 7/2001 | Moser | |
| 6,272,706 | B1 | 8/2001 | McCune | |
| 6,318,416 | B1 | 11/2001 | Grueninger | |
| 6,339,857 | B1 | 1/2002 | Clayton | |
| 6,398,199 | B1 | 6/2002 | Barber | |
| 6,481,701 | B2 | 11/2002 | Kessen | |
| 6,540,214 | B2 | 4/2003 | Barber | |
| 6,931,685 | B2 * | 8/2005 | Kuchel et al. | 5/716 |
| 6,983,503 | B2 * | 1/2006 | Ahn | 5/721 |
| 7,178,187 | B2 * | 2/2007 | Barman et al. | 5/716 |
| 2005/0050640 | A1 * | 3/2005 | Ahn | 5/721 |
| 2005/0055778 | A1 * | 3/2005 | Kuchel | 5/716 |
| 2005/0278862 | A1 * | 12/2005 | Kuchel et al. | 5/716 |
| 2006/0042016 | A1 * | 3/2006 | Barman et al. | 5/716 |

FOREIGN PATENT DOCUMENTS

| | | |
|---|---|---|
| FR | 2 697 420 | 5/1994 |
| GB | 385543 | 12/1932 |

* cited by examiner

ONE-SIDED MATTRESS

RELATED APPLICATIONS

This Application is a continuation of U.S. patent Ser. No. 10/661,327 titled One-Sided Mattress filed on Sep. 12, 2003 now U.S. Pat. No. 6,931,685, the contents of which are hereby incorporated by reference.

BACKGROUND OF THE INVENTION

1. Field of the Invention

The present invention relates to a one-sided mattress construction.

2. Description of the Related Art

Conventional mattresses may employ spring coils to support the sleeping surface. There are two basic types of coils—open coils, which are usually joined together into a spring assembly using hog rings or other fasteners, and pocket coils, which usually present a fabric exterior than can be glued to adjacent coils to form a spring assembly.

In order to facilitate the manufacture of springs and the assembly of springs into a mattress, spring coils are generally made with an approximately cylindrical shape, sometimes with a slight taper at each end to give the spring a barrel-shaped appearance. This permits secure attachment of each spring along its side into a unitary spring assembly construction. This approach works well for two-sided mattresses.

More recently, mattress makers have started manufacturing one-sided mattresses, or more specifically, single-orientation mattresses, that are designed to be placed on a foundation and used in one position over the life of the mattress. The mattress user benefits from a construction that will perform consistently over many years without requiring rotation or flipping, and the manufacturer is able to more precisely design the sleeping surface for its intended orientation.

There are significant disadvantages to the use of convention spring coils with one-sided mattress constructions. Because the tops of each spring are adjacent to, and frequently attached to, one another, vertical motion of one coil may translate into vertical motion of adjacent coils and propagate across the entire sleeping surface. As another disadvantage, springs must be attached at a substantial number of points along abutting edges to prevent shifting of the springs under use.

There remains a need for an improved spring coil assembly for use with contemporary one-sided mattresses.

SUMMARY

A one-sided mattress construction includes a spring assembly with asymmetric spring coils. Only the bottom portion of each spring coil is attached, either to adjacent spring coils or to a bottom surface of the mattress. The top portion of each spring may have a narrowing taper that permits the top to move independent of other adjacent springs.

BRIEF DESCRIPTION OF THE DRAWINGS

The present disclosure may be better understood and its numerous features and advantages made apparent to those skilled in the art by referencing the accompanying drawings.

DETAILED DESCRIPTION

Described herein is a one-sided mattress using asymmetric spring coils. However, it will be appreciated that the principles described herein may be adapted to a wide range of applications where a cushion has a fixed orientation and one top surface for sitting or sleeping. For example, the principles of this disclosure may be applied to couches where a cushion is affixed to a larger assembly. More generally, the systems described herein may be usefully employed in any environment where it is desirable to reduce translation of vertical forces over a large, padded surface.

Figure 1:
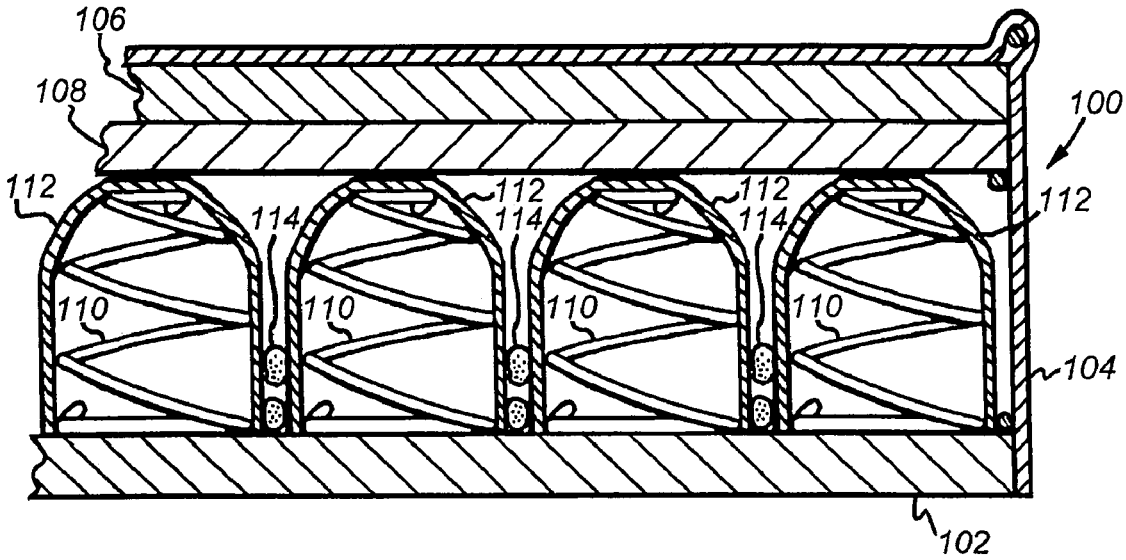
FIG. 1 shows a side view of a one-sided mattress with asymmetric spring coils.

FIG. 1 shows a side view of a one-sided mattress with asymmetric spring coils. The mattress 100 may include a bottom 102, an upholstery 104, one or more foam layers 106, one or more additional layers 108, a plurality of springs 110, each in a pocket 112, and each attached to other portions of the mattress 100 with one or more attachments 114.

The mattress 100 may be a mattress of any size, including standard sizes such as a twin, queen, oversized queen, king, or California king sized mattress, as well as custom or non-standard sizes constructed to accommodate a particular user or a particular room.

The bottom 102 may be any rigid surface suitable for forming the bottom of a one-sided mattress construction. Where one or more of the springs 110 is to be attached directly to the bottom 102, the bottom 102 may be a material such as wood or a rigid plastic suitable for affixing the springs 110 with nails, staples, screws, or other hardware. The springs 110 may also, or instead, be adhered with an epoxy or other adhesive. The bottom 102 may include recesses shaped to securely receive each spring 110, or spring 110 and pocket 112 combination.

The upholstery 104 may be a quilted surface or any other exterior surface suitable for use with a mattress.

The one or more foam layers 106 may include any foam or other padding suitable for cushioning the sleeping surface during use. For example, visco-elastic foam toppers are commonly used in mattresses surfaces, and may have various thicknesses, densities, and Indentation Force Deflections ("IFD"). The one or more foam layers 106 may include a single, uniform foam piece, or a number of layers of foam, and may provide for different firmness and/or thickness in different regions of the sleeping surface.

The additional layers 108 may include any materials suitable for a mattress, such as batting, foam, waterproof liners, and so forth. In certain assemblies using asymmetric coils, the one or more additional layers 108 may include a relatively firm layer that distributes the upward force of each narrow spring top to provide a more uniform feel to the sleeping surface.

The plurality of springs 110 may have a generally asymmetric construction, as described in greater detail with reference to FIG. 2 below. In general, each spring will have a top end diameter smaller than a center or bottom diameter of the spring. A typical coil may have a height of 8 to 10 inches (out of the mattress 100 and out of a pocket 112, if any), a diameter of 1 to 3 inches varying along its length, and 6 to 8 turns. One suitable wire for forming coils is 0.070 inches in diameter, and may provide a tensile range for the coil of 285-315 kpsi. It will be appreciated that other wires and spring configurations may be used without departing from the scope of the invention described herein.

Each spring 110 may be enclosed by a pocket 112 of fabric. It will be appreciated that pocket coils of this type may be manufactured in single pocket coils or strings of pocket coils, either of which may be suitably employed with the mattresses described herein. Although not depicted in FIG. 1, the mattress 100 may also, or instead, use open coils that are not contained within any pocket 112.

The attachment 114 between coils 110 may be any suitable attachment. For example, pocket coils are commonly attached to one another using hot-melt adhesive applied to abutting surfaces during construction. Other adhesives may be used. Open coils, on the other hand, are commonly attached to one another using hog rings or other metal clips. It will be noted from FIG. 1 that adjacent springs are only attached along a bottom portion thereof. Depending upon the shape of the outer surface of each spring 110, this bottom attached portion may be the bottom 25%, the bottom 50%, or the bottom 75%, or some other lower portion of each spring 110. A top portion of the spring is then free to move independent of adjacent springs 110. It should also be appreciated that, where a suitably strong attachment is provided to the bottom 102, the side attachments 114 may be omitted entirely.

The mattress 100 of FIG. 1, and any variations thereof, may be manufactured using techniques known in the art of mattress making, with variations to achieve the mattress 100 described above. Thus there is disclosed herein a method for manufacturing a mattress that includes providing the spring coils 110, arrange the spring coils 110 in a manner suitable for use in a mattress core, and attaching a bottom portion of each spring coil 110 to either an adjacent spring coil 110 using an attachment 114 or to the bottom 102 of the mattress 100, or to both the bottom 102 and adjacent spring coils 110. The mattress 100 may then be enclosed in an upholstery 104 and any other layers 106, 108 using adhesives, hog rings, staples, and/or other techniques known in the art.

An asymmetric spring for use in a one-sided mattress is now described in greater detail.

Figure 2A:
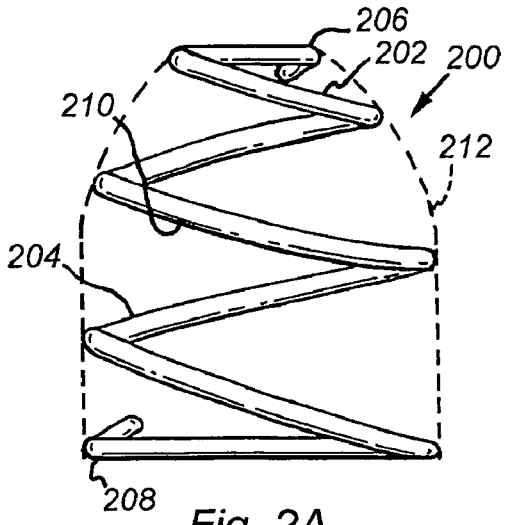
FIGS. 2A and 2B show an asymmetric spring coil that may be used with the mattress of FIG. 1.

FIG. 2A shows a side view of an asymmetric spring coil that may be used with the mattress of FIG. 1. In general, the spring coil 200 is formed from suitably thick and resilient wire into a coil having a top portion 202, a bottom portion 204, a top end 206, a bottom end 208, a middle portion 210, and an exterior surface 212 formed along the exterior edges of the spring coil 200.

A cross section of the outer surface 212, as depicted in FIG. 2A, shows that the bottom portion 204 and the middle portion 210 are generally similar in width, while the top portion is significantly narrower. As depicted, this taper occurs beginning around the middle portion 210 of the spring coil 200, however, it may also occur nearer to the top portion 202 or the bottom portion 204. In an embodiment, the width may be uniform throughout the bottom portion 204.

In general, the spring coil 200 should have a wide bottom portion 204 to provide secure attachment to the bottom 102 (FIG. 1) of the mattress 100, while the top portion 202 should become narrower to permit independent vertical movement of the top portion 202 when arranged adjacent to other spring coils 200. The taper of the outer surface 212 may become gradually narrower toward the top end 206. A number of tapers may be suitably employed for this purpose. One such taper is a convex longitudinal taper that bows out along its length. This convex longitudinal taper may have a radius of curvature that monotonically decreases from the bottom end 208 to the top end 206 of the spring coil 200. "Monotonically decreasing" is intended here in its ordinary mathematical sense of always decreasing or remaining constant, but never increasing. As the radius of curvature monotonically decreases, the curve becomes steeper and the taper becomes more narrow more quickly. As noted above other longitudinal tapers may be employed within the general constraints of a wider bottom portion 204 and a narrower top portion 202.

It will be appreciated that the narrowing taper provides certain advantages. As noted above, the physical separation of each top end may reduce the affect that compression of one spring has upon its neighbors. This translates into increased independence of vertical motion, and prevents compression in one region of the mattress from propagating across the mattress surface. Further, the physical separation may reduce the snagging that sometimes occurs among adjacent springs over the life of a mattress in which the spring ends become intertwined or hooked together. At the same time, the wider base may ensure a secure point of attachment to adjacent springs in a spring assembly.

The bottom end 208 and the top end 206 may include a turn in where the length of wire is turned into the interior of the outer surface 212. This reduces snagging of each spring on other springs or other materials within the interior of the mattress 100 (FIG. 1), as well as puncturing of mattress materials by the ends 206, 208.

Figure 2B:
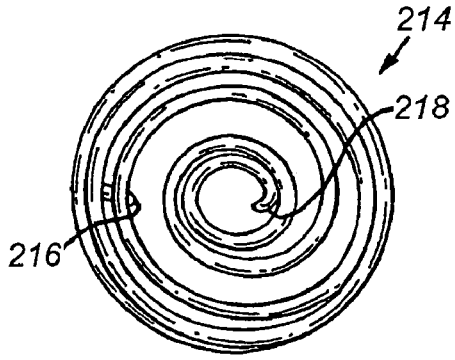

FIG. 2B shows a top view of an asymmetric spring coil that may be used with the mattress of FIG. 1. As generally depicted in FIG. 2B, the coil 214, which may be a coil such as the coil described above with reference to FIG. 2A, may include a bottom end 216 and a top end 218, with the wire of the coil 214 becoming more closely wound near the top end 218 thereof.

While particular embodiments of the present invention have been shown and described, it will be apparent to those skilled in the art that changes and modifications may be made without departing from the scope of the invention, and therefore, the following claims are to be interpreted in the broadest sense allowable by law.

What is claimed is:

1. A mattress, comprising a plurality of adjacent asymmetric pocketed spring coils being unattached to an adjacent asymmetric spring coil along a top half of that spring coil, and attached to a bottom portion of an adjacent spring coil such that a top portion of the spring coil and a top portion of the at least one adjacent spring coil are independently moveable with respect to one another.

2. The mattress of claim 1, wherein a plurality of said spring coils are attached to form a string of attached coils which are unattached to adjacent strings of coils.

3. The mattress of claim 1, wherein said spring coils are attached to at least one adjacent spring coil with an adhesive.

4. The mattress of claim 1, wherein said spring coils are attached to at least one adjacent spring coil with a hog ring.

5. The mattress of claim 1, wherein said spring coils have a top and a bottom interconnected by a continuous coil of wire having a convex longitudinal taper along an exterior surface thereof, the convex longitudinal taper having a radius of curvature that monotonically decreases from the bottom of the spring coil to the top of the spring coil.

6. The mattress of claim 1, wherein the spring coils have a top with a first width, a middle with a second width, and a bottom with a third width, the top and the bottom connected by a continuous coil of wire, the spring coil having a longitudinal taper such that the third width of the bottom is substantially equal to the second width of the middle, and the first width of the top is smaller than the second width of the middle.

7. The mattress of claim 1, wherein the mattress has a rigid bottom surface, and the plurality of spring coils are attached to the bottom surface of the mattress.

8. A method of manufacturing a mattress comprising:

providing a plurality of spring coils;

arranging the plurality of spring coils adjacent to one another in a manner suitable for use in a mattress core;

attaching a bottom portion of each one of the plurality of spring coils to at least one other one of the plurality of spring coils; and enclosing the plurality of spring coils in one or more upholstery layers without attaching a top half of any one of the plurality of spring coils to any other one of the plurality of spring coils.

9. The method of claim 8, wherein the spring coils are asymmetric coils.

10. The method of claim 8, wherein a plurality of said spring coils are attached to form a string of attached coils which are unattached to adjacent strings of coils.

11. The method of claim 8, wherein said spring coils are attached to at least one adjacent spring coil with an adhesive.

12. The method of claim 8, wherein said spring coils are attached to at least one adjacent spring coil with a hog ring.

13. The method of claim 8, wherein the plurality of spring coils have a top and a bottom interconnected by a continuous coil of wire having a convex longitudinal taper along an exterior surface thereof, the convex longitudinal taper having a radius of curvature that monotonically decreases from the bottom of the spring coil to the top of the spring coil.

14. The method of claim 8, wherein the plurality of spring coils have a top with a first width, a middle with a second width, and a bottom with a third width, the top and the bottom connected by a continuous coil of wire, the spring coil having a longitudinal taper such that the third width of the bottom is substantially equal to the second width of the middle, and the first width of the top is smaller than the second width of the middle.

* * * * *